US011351776B2

(12) United States Patent
Ng et al.

(10) Patent No.: US 11,351,776 B2
(45) Date of Patent: Jun. 7, 2022

(54) SELECTORS FOR NOZZLES AND MEMORY ELEMENTS

(71) Applicant: HEWLETT-PACKARD DEVELOPMENT COMPANY, L.P., Spring, TX (US)

(72) Inventors: Boon Bing Ng, Vancouver, WA (US); Rui Pan, Singapore (SG); Mohan Kumar Sudhakar, Singapore (SG); Brendan Hall, Leixlip (IE)

(73) Assignee: Hewlett-Packard Development Company, L.P., Spring, TX (US)

( * ) Notice: Subject to any disclaimer, the term of this patent is extended or adjusted under 35 U.S.C. 154(b) by 379 days.

(21) Appl. No.: 16/479,822

(22) PCT Filed: Jul. 6, 2017

(86) PCT No.: PCT/US2017/040881
§ 371 (c)(1),
(2) Date: Jul. 22, 2019

(87) PCT Pub. No.: WO2019/009904
PCT Pub. Date: Jan. 10, 2019

(65) Prior Publication Data
US 2021/0354444 A1 Nov. 18, 2021

(51) Int. Cl.
*B41J 2/045* (2006.01)
*B41J 2/01* (2006.01)

(52) U.S. Cl.
CPC ..... *B41J 2/0455* (2013.01); *B41J 2/0458* (2013.01); *B41J 2/04521* (2013.01);
(Continued)

(58) Field of Classification Search
CPC .. B41J 2/0455; B41J 2/04521; B41J 2/04541; B41J 2/0458; B41J 2/04581; B41J 2/01
See application file for complete search history.

(56) References Cited

U.S. PATENT DOCUMENTS 6,439,697 B1 8/2002 Axtell et al.
7,258,411 B2 8/2007 Anderson et al.
(Continued)

FOREIGN PATENT DOCUMENTS

CN 101480874 7/2009
CN 101784392 7/2010
(Continued)

OTHER PUBLICATIONS

Zwang, D.; "Drupa 2012, the Inkjet Drupa . . . again? A closer look at Xerox"; Nov. 28, 2011; http://whattheythink.com/articles/55245-drupa-2012-inkjet-drupaagain-closer-look-xerox/.

*Primary Examiner* — Yaovi M Ameh
(74) *Attorney, Agent, or Firm* — Trop Pruner & Hu PC

(57) ABSTRACT

In some examples, a circuit for use with a memory element and a nozzle for outputting fluid, includes a data line, a fire line, and a selector responsive to the data line to select the memory element or the nozzle. The selector is to select the memory element responsive to the data line having a first value, and to select the nozzle responsive to the data line having a second value different from the first value. The fire line is to control activation of the nozzle in response to the nozzle being selected by the selector, and to communicate data of the memory element in response to the memory element being selected by the selector.

20 Claims, 11 Drawing Sheets

(52) U.S. Cl.
CPC ..... *B41J 2/04541* (2013.01); *B41J 2/04581* (2013.01); *B41J 2/01* (2013.01)

(56) References Cited

U.S. PATENT DOCUMENTS

| | | | | |
|---|---|---|---|---|
| 7,278,703 | B2 | 10/2007 | Benjamin et al. | |
| 7,372,475 | B2 | 5/2008 | Vazac et al. | |
| 7,497,536 | B2 | 3/2009 | Benjamin | |
| 7,543,906 | B2 | 6/2009 | Benjamin et al. | |
| 7,635,174 | B2 | 12/2009 | Bergstedt et al. | |
| 8,474,943 | B2 | 7/2013 | Ness et al. | |
| 8,864,260 | B1 | 10/2014 | Ge et al. | |
| 2002/0186265 | A1 | 12/2002 | Schloeman et al. | |
| 2003/0081028 | A1 | 5/2003 | Feinn et al. | |
| 2007/0097745 | A1 | 5/2007 | Benjamin | |
| 2007/0153030 | A1 | 7/2007 | Walmsley | |
| 2009/0284558 | A1 | 11/2009 | Cerutti | |
| 2010/0302293 | A1* | 12/2010 | Torgerson | B41J 2/04586 347/10 |
| 2013/0093813 | A1 | 4/2013 | Davis et al. | |
| 2014/0320541 | A1 | 10/2014 | Hekmatshoartabari | |
| 2014/0320558 | A1* | 10/2014 | Ge | B41J 2/0458 347/9 |
| 2015/0035883 | A1 | 2/2015 | Fukuda | |
| 2016/0144618 | A1 | 5/2016 | Liao et al. | |
| 2016/0254811 | A1 | 9/2016 | Otsuka et al. | |

FOREIGN PATENT DOCUMENTS

| | | | |
|---|---|---|---|
| CN | 101868356 | | 10/2010 |
| CN | 102307731 | | 1/2012 |
| JP | 2000238245 | A | 9/2000 |
| JP | 2004090262 | | 3/2004 |
| KR | 10-2004-0037895 | A | 5/2004 |
| WO | WO-2009064271 | | 5/2009 |
| WO | WO-2015116129 | | 8/2015 |
| WO | WO-2016014082 | | 1/2016 |
| WO | WO-2016018199 | | 2/2016 |
| WO | WO-2017019091 | | 2/2017 |
| WO | 2019/009904 | A1 | 1/2019 |

* cited by examiner

SELECTORS FOR NOZZLES AND MEMORY ELEMENTS

BACKGROUND

A printing system can include a printhead that has nozzles to dispense printing fluid to a target. In a two-dimensional (2D) printing system, the target is a print medium, such as a paper or another type of substrate onto which print images can be formed. Examples of 2D printing systems include inkjet printing systems that are able to dispense droplets of inks. In a three-dimensional (3D) printing system, the target can be a layer or multiple layers of build material deposited to form a 3D object.

BRIEF DESCRIPTION OF THE DRAWINGS

Some implementations of the present disclosure are described with respect to the following figures.

Figure 1:
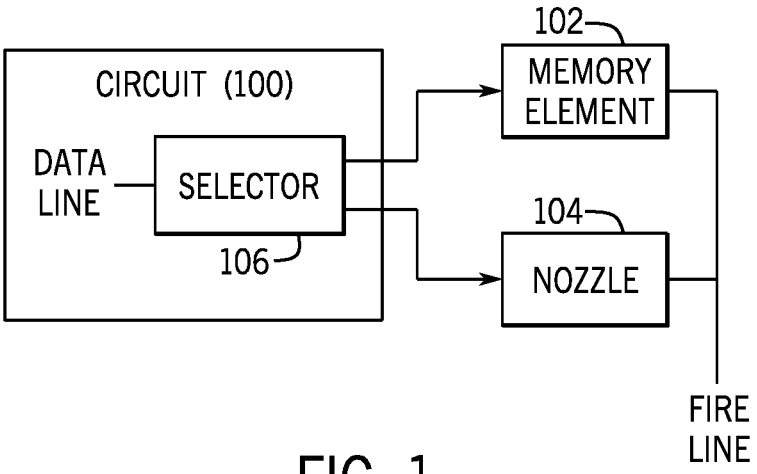
FIG. 1 is a block diagram of an arrangement including a circuit, a memory element, and a nozzle, according to some examples.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an", or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

A printhead for use in a printing system can include nozzles that are activated to cause printing fluid droplets to be ejected from respective nozzles. Each nozzle includes a nozzle activation element. The nozzle activation element when activated causes a printing fluid droplet to be ejected by the corresponding nozzle. In some examples, a nozzle activation element includes a heating element (e.g., a thermal resistor) that when activated generates heat to vaporize a printing fluid in a firing chamber of the nozzle. The vaporization of the printing fluid causes expulsion of a droplet of the printing fluid from the nozzle. In other examples, a nozzle activation element includes a piezoelectric element. When activated, the piezoelectric element applies a force to eject a printing fluid droplet from a nozzle. In further examples, other types of nozzle activation elements can be employed.

A printing system can be a two-dimensional (2D) or three-dimensional (3D) printing system. A 2D printing system dispenses printing fluid, such as ink, to form images on print media, such as paper media or other types of print media. A 3D printing system forms a 3D object by depositing successive layers of build material. Printing fluids dispensed from the 3D printing system can include ink, as well as agents used to fuse powders of a layer of build material, detail a layer of build material (such as by defining edges or shapes of the layer of build material), and so forth.

In the ensuing discussion, the term "printhead" can refer generally to a printhead die or an overall assembly that includes multiple dies mounted on a support structure. A die (also referred to as an "integrated circuit (IC) die") includes a substrate on which is provided various layers to form nozzles and/or control circuitry to control ejection of a fluid by the nozzles.

Although reference is made to a printhead for use in a printing system in some examples, it is noted that techniques or mechanisms of the present disclosure are applicable to other types of fluid ejection devices used in non-printing applications that are able to dispense fluids through nozzles. Examples of such other types of fluid ejection devices include those used in fluid sensing systems, medical systems, vehicles, fluid flow control systems, and so forth.

In some examples, a fluid ejection device can be implemented with one die. In further examples, a fluid ejection device can include multiple dies.

As devices, including printhead dies or other types of fluid ejection dies, continue to shrink in size, the number of signal lines used to control circuitry of a device can affect the overall size of the device. A large number of signal lines can lead to using a large number of signal pads (referred to as "bond pads") that are used to electrically connect the signal lines to external lines. Adding features to fluid ejection devices can lead to use of an increased number of signal lines (and corresponding bond pads), which can take up valuable die space, for example. Examples of additional features that can be added to a fluid ejection device include memory devices.

In accordance with some implementations of the present disclosure, different circuitry of a fluid ejection device (that includes one die or multiple dies) can share control and data lines to allow for a reduction in the number of signal lines of the fluid ejection device that have to be connected to an external line. As used here, the term "line" can refer to an electrical conductor (or alternatively, multiple electrical conductors) that can be used to carry a signal (or multiple signals).

As shown in FIG. 1, in some examples, a circuit 100 for use with a memory element 102 and a nozzle 104 includes a data line, a fire line, and a selector 106. The memory element 102 can include a memory cell (or a group of memory cells) that can store data. The memory element 102 can be part of an array (or other collection) of memory elements that form part of a memory. The nozzle 104 can include a nozzle activation element, a fluid chamber, and a fluid orifice, where the nozzle activation element when activated causes fluid in the fluid chamber to be ejected through the fluid orifice to an environment outside the nozzle 104.

In examples where the fluid ejection device is associated with multiple different memories, the data line can be used to communicate data of a first memory of the multiple different memories. The memory element 102 can be part of a second memory of the multiple different memories. For example, the first memory can be an ID memory that is used to store identification data (and possibly other information) of the fluid ejection device (to uniquely identify the fluid ejection device). The ID memory may also store other data. In such examples, the data line can be referred to as an ID line that is used to communicate data (write data or read data) of the ID memory.

The second memory can store ejection data, which can be used to enable or disable certain nozzles. In other examples, the second memory can store other data.

In some examples, the different memories can be on a fluid ejection die that also includes nozzles for outputting (dispensing) fluid. In other examples, the different memories can be on a die (or multiple dies) that is (are) separate from the fluid ejection die. For example, the first memory and the second memory can be part of a die that is separate from the fluid ejection die, or the first memory and the second memory can be part of respective dies that are separate from the fluid ejection die The selector 106 is responsive to a value of the data line to select the memory element 102 or the nozzle 104. Note that the data line is used to communicate data, in contrast with address data lines that are used to carry an address. A specific example of a data line is an ID line (explained further below). The selector 106 selects the memory element 102 in response to the data line having a first value, and selects the nozzle 104 in response to the data line having a second value different from the first value. The fire line controls activation of the nozzle 104 in response to the nozzle 104 being selected by the selector 106, and communicates data (writes data or reads data) of the memory element 102 in response to the memory element 102 being selected by the selector 106.

In some examples, the circuit 100 can be part of the same die as the memory element 102 and the nozzle 104. For example, a fluid ejection die can include the circuit 100, the memory element 102, and the nozzle 104. In other examples, the circuit 100 can be separate from the die(s) that include(s) the memory element 102 and/or the nozzle 104. For example, the circuit 100 can be formed on a flex cable, a circuit board, a die, or any other structure that is separate from the die(s) that include(s) the memory element 102 and/or the nozzle 104.

Figure 2:
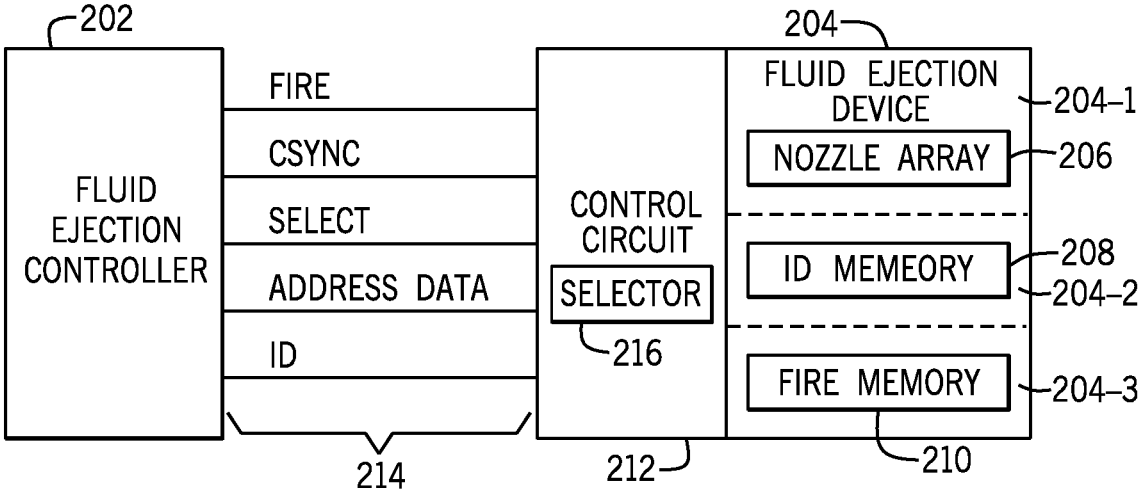
FIG. 2 is a block diagram of a system according to further examples.

FIG. 2 is a block diagram of an example system, which can include a printing system or other type of fluid dispensing system. The system includes a fluid ejection controller 202 and a fluid ejection device 204. The fluid ejection controller 202 is separate from the fluid ejection device 204. For example, in a printing system, the fluid ejection controller 202 is a printhead drive controller that is part of the printing system, while the fluid ejection device 204 is a printhead die that is part of a print cartridge (that includes ink or another agent) or can be located on another structure.

The fluid ejection device 204 includes respective portions 204-1, 204-2, and 204-3. The portion 204-1 includes a nozzle array 206, which includes an array of nozzles that are selectively controllable to dispense fluid. The portion 204-2 includes an ID memory 208, such as to store identification data of the fluid ejection device 204. The portion 204-3 includes a fire memory 210, which can be used to store data relating to the nozzle array 206, where the data can include any or some combination of the following, as examples: die location, region information, drop weight encoding information, authentication information, data to enable or disable selected nozzles, and so forth. The memory element 102 of FIG. 1 can be part of the fire memory 210 of FIG. 2, in some examples.

In some examples, the ID memory 208 and the fire memory 210 can be implemented with different types of memories to form a hybrid memory arrangement. The ID memory 208 can be implemented with an electrically programmable read-only memory (EPROM), for example. The fire memory 210 can be implemented with a fuse memory, where the fuse memory includes an array of fuses that can be selectively blown (or not blown) to program data into the fire memory 210. Although specific examples of types of memories are listed above, it is noted that in other examples, the ID memory 208 and the fire memory 210 can be implemented with other types of memories. In some cases, the ID memory 208 and the fire memory 210 can be implemented with the same type of memory.

Moreover, although specific types of data are indicated as being stored by the ID memory 208 and the fire memory 210, it is noted that in other examples, the memories 208 and 210 can store other or additional types of data.

In some examples, the portions 204-1, 204-2, and 204-3 of the fluid ejection device 204 can be formed on a common die (i.e., a fluid ejection die) such that the nozzle array 206, ID memory 208, and fire memory 210 are formed on a single die. In other examples, the portion 204-1 can be implemented on one die (the fluid ejection die that includes the nozzle array 206), while the portions 204-2 and 204-3 are implemented on a separate die (or respective separate dies). For example, the ID memory 208 and the fire memory 210 can be formed on a second die that is separate from the fluid ejection die, or alternatively, the ID memory 208 and the fire memory 210 can be formed on respective different dies separate from the fluid ejection die. In further examples, the ID memory 208 and the nozzle array 206 can be part of one die, while the fire memory 210 is part of another die. In other examples, the fire memory 210 and the nozzle array 206 can be part of one die, and the ID memory 208 is part of another die. In further examples, part of the ID memory 208 can be on one die, and another part of the ID memory 208 can be on another die. In yet further examples, part of the fire memory 210 can be part of one die, and another part of the ID memory 208 can be part of another die.

Figure 2A:
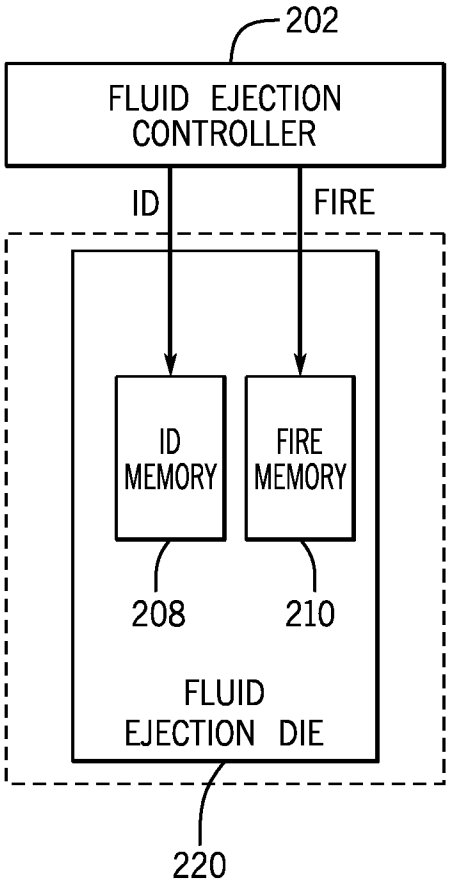
FIGS. 2A-2G are block diagrams of various systems according to various examples.

The following are further examples of different arrangements. In a first arrangement, as shown in FIG. 2A, both the ID memory 208 and the fire memory 210 can be on a fluid ejection die 220. The ID line is used to communicate data between the fluid ejection controller 202 and the ID memory 208 on the fluid ejection die, and the fire line is used to communicate data between the fluid ejection controller 202 and the fire memory 210 on the fluid ejection die.

Figure 2B:
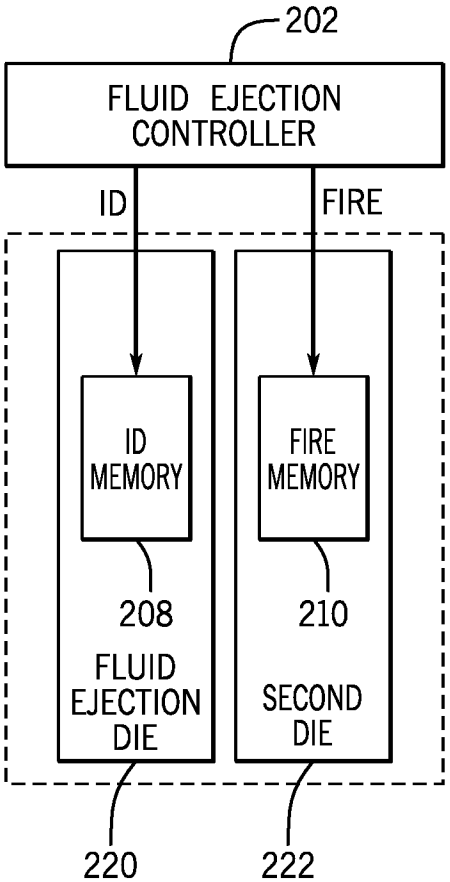

In a second arrangement, as shown in FIG. 2B, the ID memory 208 is part of the fluid ejection die 220, and the fire memory 210 is part of a second die 222. The ID line is used to communicate data between the fluid ejection controller 202 and the ID memory 208 on the fluid ejection die 220, and the fire line is used to communicate data between the fluid ejection controller 202 and the fire memory 210 on the second die 222.

Figure 2C:
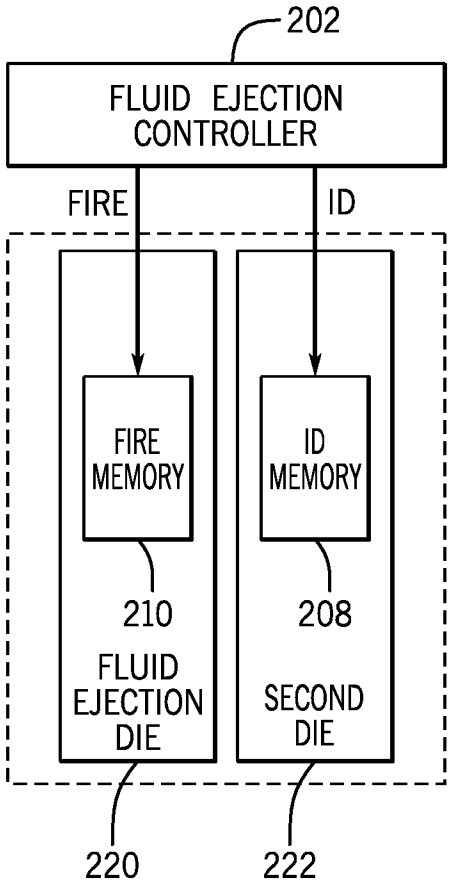

In a third arrangement, as shown in FIG. 2C, the fire memory 210 is part of the fluid ejection die 220, and the ID memory 208 is part of a second die 222. The ID line is used to communicate data between the fluid ejection controller 202 and the ID memory 208 on the second die 222, and the fire line is used to communicate data between the fluid ejection controller 202 and the fire memory 210 on the fluid ejection die 220.

Figure 2E:
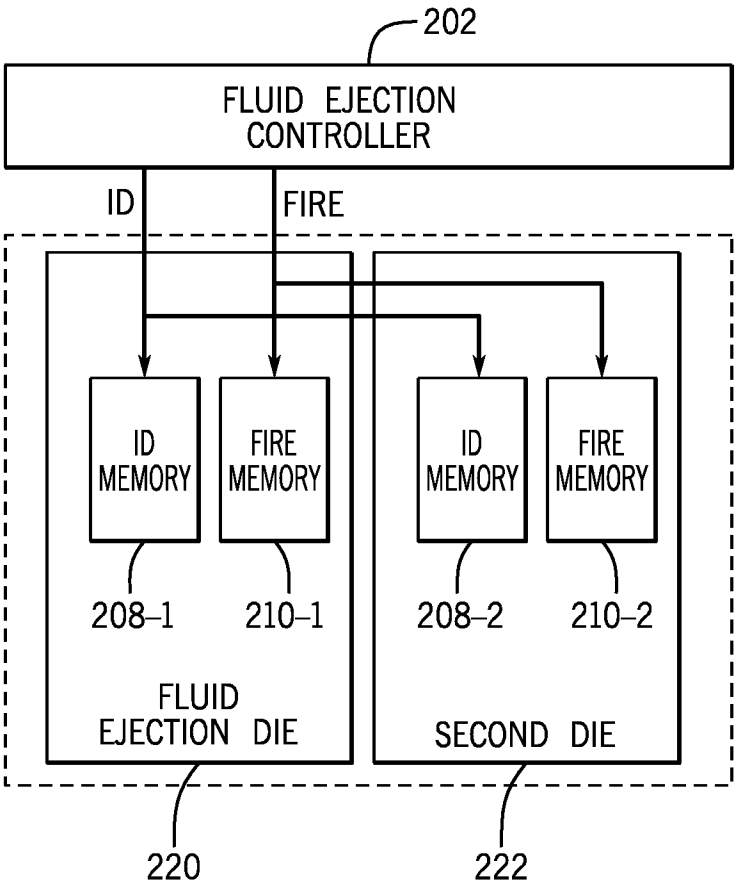
Figure 2D:
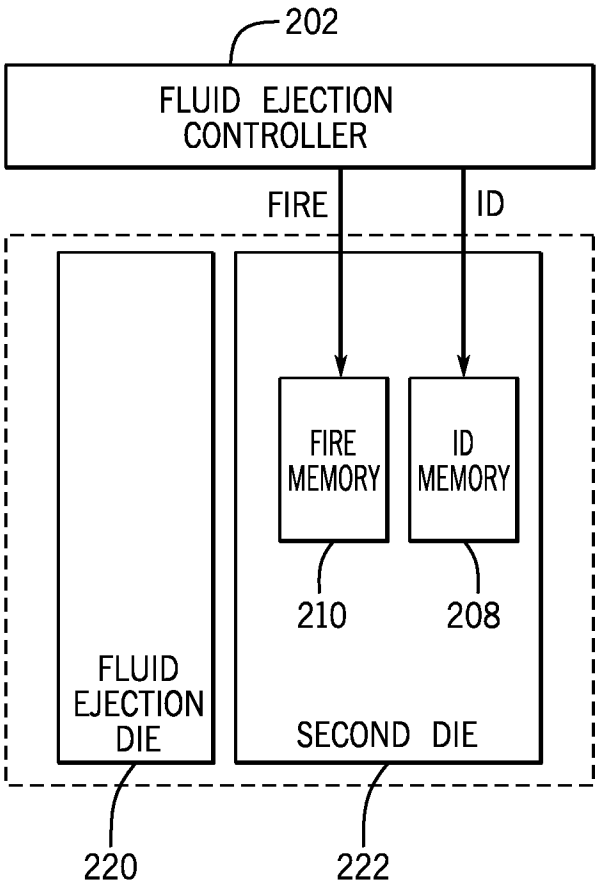

In a fourth arrangement, as shown in FIG. 2D, the ID memory 208 and the fire memory 210 are one a second die 220 separate from the fluid ejection die 220. The ID line is used to communicate data between the fluid ejection controller 202 and the ID memory 208 on the second die 222, and the fire line is used to communicate data between the fluid ejection controller 202 and the fire memory 210 on the second die 222.

In a fifth arrangement, as shown in FIG. 2E, both a first part 208-1 of the ID memory and a first part 210-1 of the fire memory can be on the fluid ejection die 220, and a second part 208-2 of the ID memory and a second part 210-2 of the fire memory can be on a second die 222. The ID line is used to communicate data between the fluid ejection controller 202 and the ID memory parts 208-1 and 208-2 on the fluid ejection die 220 and the second die 222, and the fire line is used to communicate data between the fluid ejection controller 202 and the fire memory parts 210-1 and 210-2 on the fluid ejection die 220 and the second die 222.

Figure 2G:
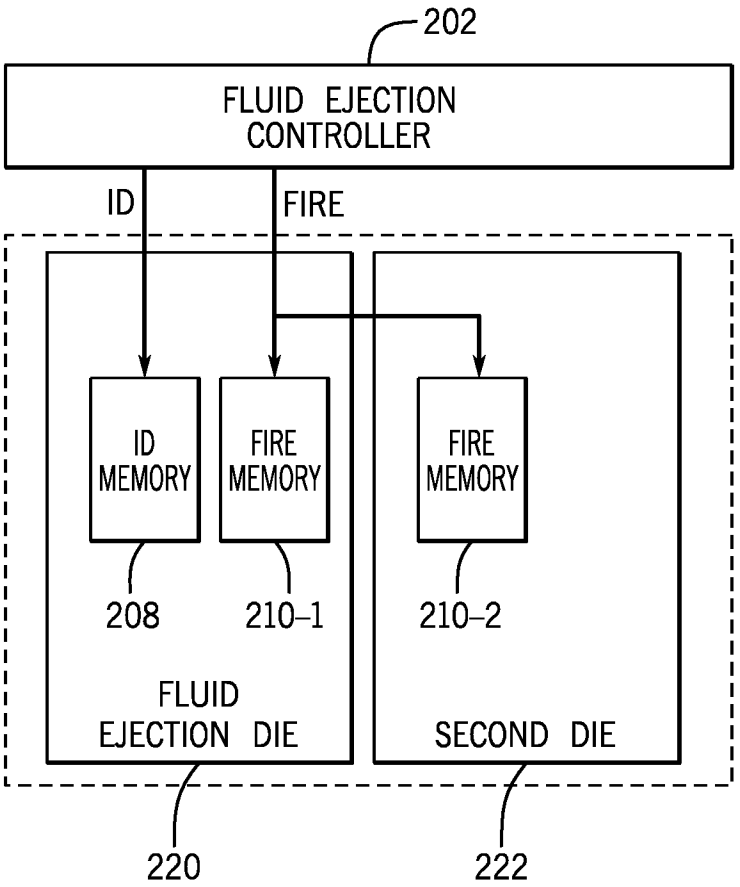
Figure 2F:
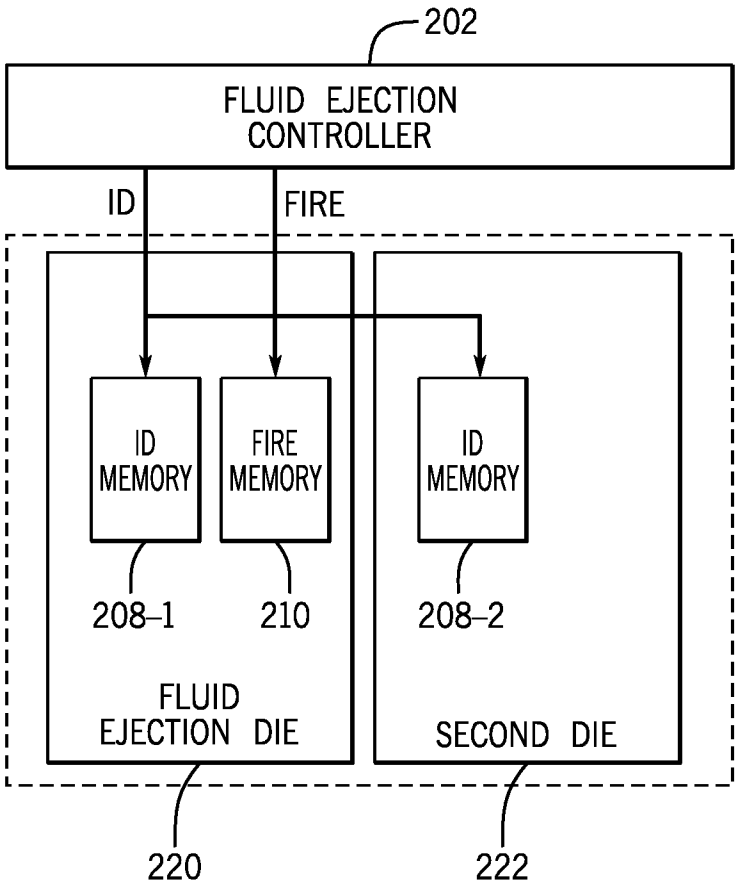

In a sixth arrangement, as shown in FIG. 2F, a first part 208-1 of the ID memory and the fire memory 210 can be on the fluid ejection die 220, and a second part 208-2 of the ID memory can be on a second die 222. The ID line is used to communicate data between the fluid ejection controller 202 and the ID memory parts 208-1 and 208-2 on the fluid ejection die 220 and the second die 222, and the fire line is used to communicate data between the fluid ejection controller 202 and the fire memory 210 on the fluid ejection die 220.

In a seventh arrangement, as shown in FIG. 2G, the ID memory 208 and a first part 210-1 of the fire memory can be on the fluid ejection die 220, and a second part 210-2 of the fire memory can be on a second die 222. The ID line is used to communicate data between the fluid ejection controller 202 and the ID memory 208 on the fluid ejection die 220, and the fire line is used to communicate data between the fluid ejection controller 202 and the fire memory parts 210-1 and 210-2 on the fluid ejection die 220 and the second die 222.

In other example arrangements, more than one second die can be employed in addition to the fluid ejection die, where ID memory part(s) and/or fire memory part(s) can be distributed across the multiple second dies.

Moreover, although FIG. 2 shows an example where there are two different types of memories, it is noted that in other examples, just one type of memory can be included in the fluid ejection device 204.

The fluid ejection device 204 is associated with a control circuit 212 that is responsive to various control signals communicated over control lines 214 to control activation or access of the nozzle array 206, the ID memory 208, and the fire memory 210. The control lines 214 include a fire line, a CSYNC line, a select line, an address data line, an ID line, and other lines. In other examples, there can be multiple fire lines, and/or multiple select lines, and/or multiple address data lines.

The control circuit 212 includes a selector 216 (that is similar to the selector 106 of FIG. 1). The selector 216 can select one of the nozzle array 206 and the fire memory 210, based on the value of a data line (which in FIG. 2 is the ID line that is used to write and read identification data of the ID memory 208).

The fire line is used to control activation of the nozzle array 206, when the nozzle array 206 is selected by the selector 216 in response to a first value of the ID line. A fire signal carried by the fire line when set to a first state causes a respective nozzle (or nozzles) to be activated if such nozzle (or nozzles) are addressed based on values of the select and address data lines. If the fire signal is at a second value different from the first value, then the nozzle (or nozzles) are not activated.

The CSYNC signal is used to initiate an address (referred to as Ax and Ay in the ensuing discussion) in the fluid ejection device 204. The select line can be used to select certain nozzles or memory elements. The address data line is used to carry an address bit (or address bits) to address a specific nozzle or memory element (or a specific group of nozzles or group of memory elements).

In accordance with some implementations of the present disclosure, to enhance flexibility and to reduce the number of input/output (I/O) pads that have to be provided on the fluid ejection device 204, each of the fire line and the ID line (or more generally, a data line) performs both primary and secondary tasks. As noted above, the primary task of the fire line is to activate selected nozzle(s). The secondary task of the fire line is to communicate data of the fire memory 210. In this manner, a data path can be provided between the fluid ejection controller 202 and the fire memory 210 (over the fire line), without having to provide a separate data line between the fluid ejection controller 202 and the fluid ejection device 204.

The primary task of the ID line is to communicate data of the ID memory 208. The secondary task of the ID line is to cause the selector 216 to select one of the nozzle array 206 and the fire memory 210. In this manner, a common fire line can be used to control activation of the nozzle array 206 and to communicate data of the fire memory 210, where the ID line is used to select when the nozzle array 206 is controlled by the fire line and when the fire line can be used to communicate data of the fire memory 210.

Figure 3:
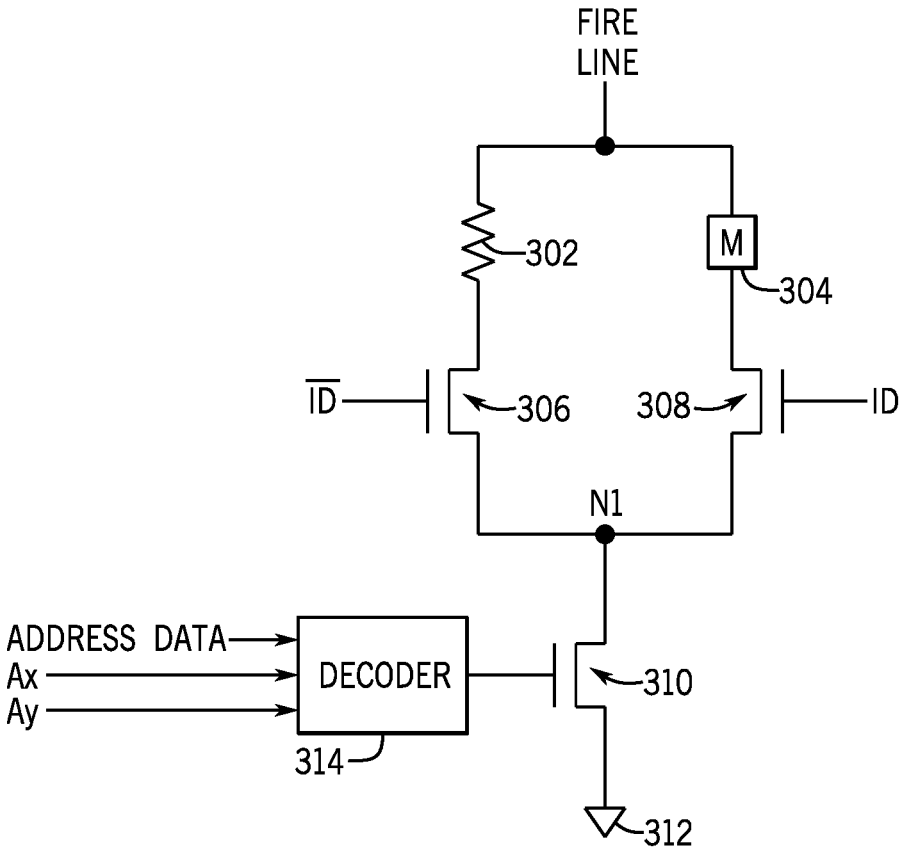
FIGS. 3, 4, 5, 5A, 5B, 6, and 7 are schematic diagrams of circuits that include a nozzle activation element, a memory element, and a selection circuit according to various examples.

FIG. 3 is a schematic diagram of a circuit that includes a nozzle activation element 302 and a memory element 304. In some examples, the nozzle activation element 302 is in the form of a thermal resistor that when activated heats fluid in a fluid chamber of a nozzle, to cause the fluid to be ejected from a fluid orifice of the nozzle. In other examples, the nozzle activation element can include a piezoelectric element or other type of nozzle activation element. The memory element 304 can be part of the fire memory 210 of FIG. 2, in some examples.

In FIG. 3, a first switch (which can be implemented using a transistor 306) is connected in series with the nozzle activation element 302 between the fire line and a node N1. A second switch (which can be implemented using a transistor 308) is connected in series with the memory element 304 between the fire line and the node N1. The transistor 306 has a gate controlled by $\overline{ID}$, and the transistor 308 has a gate controlled by ID. $\overline{ID}$ represents an inverse of ID. For example, ID can be provided to an input of an inverter, which produces $\overline{ID}$.

Thus, when the transistor 308 is turned on by ID (set to an active value such as a high value), the transistor 306 is turned off by off $\overline{ID}$ (since $\overline{ID}$ is set to an inactive value such as a low value). On the other hand, when the transistor 306 is turned on by $\overline{ID}$ (set to an active value such as a high value), the transistor 308 is off.

In this manner, the transistors 306 and 308 can select either the nozzle activation element 302 or the memory element 304. The transistors 306 and 308 in the arrangement of FIG. 3 are part of the selector 106 (FIG. 1) or selector 216 (FIG. 2).

FIG. 3 further depicts a switch (implemented as a transistor 310) between the node N1 and a reference voltage 312, such as ground. The gate of the transistor 310 is connected to an output of a decoder 314, which receives an address input. The decoder 314 can be part of the control circuit 212 shown in FIG. 2.

The address input includes an address provided by address bit(s) of the address data line, and Ax and Ay signals. The Ax and Ay signals are output by an address generator (not shown in FIG. 3) in response to the select line and the CSYNC line, in some examples. Although a specific address input is depicted in FIG. 3, it is noted that the decoder 314 generally receives an address as an input and controls the activation of the transistor 310 based on the address. The decoder can effectively activate or maintain deactivated the nozzle activation element 302 or the memory element 304 (as selected by the ID line) in response to the address input.

In general, according to FIG. 3, a circuit for use with a memory element and a nozzle for outputting fluid includes a data line, a fire line, and a selector. The selector includes a first switch responsive to a first value of the data line to select the memory element, and includes a second switch responsive to a second value of the data line to select the nozzle. The fire line controls activation of the nozzle in response to the nozzle being selected by the selector, and to communicate data of the memory element in response to the memory element being selected by the selector. The circuit further includes a decoder responsive to an address input to select the memory element or the nozzle.

Figure 4:
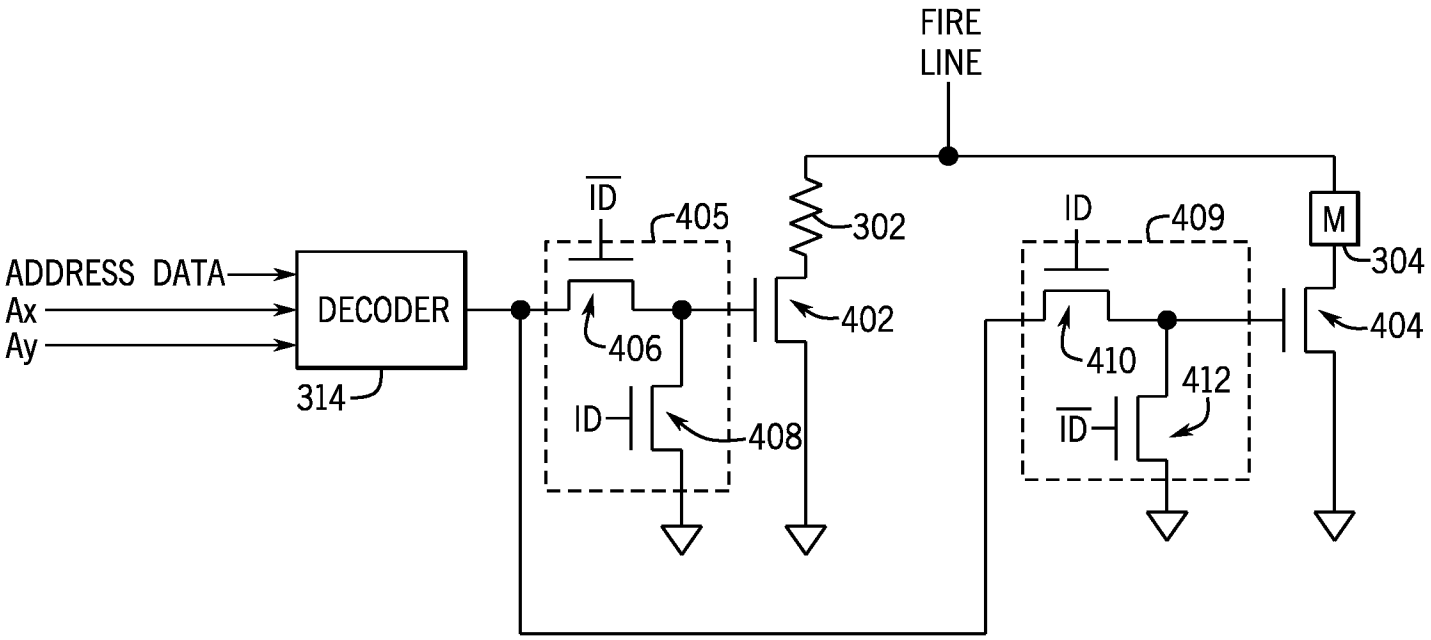

FIG. 4 is a schematic diagram of another example arrangement for selectively activating/accessing the nozzle activation element 302 and the memory element 304. In FIG. 4, a first transistor 402 is connected in series with the nozzle activation element 302 between the fire line and a reference voltage, and a second transistor 404 is connected in series with the memory element 304 between the fire line and a reference voltage.

The gate of the transistor 402 is connected to a first arrangement 405 of switches that include a transistor 406 (controlled by $\overline{ID}$) and a transistor 408 (controlled by ID). The transistor 406 when turned on by $\overline{ID}$ connects the output of the decoder 314 to the gate of the transistor 402. The transistor 408 is connected between the gate of the transistor 402 and a reference voltage.

The gate of the transistor 404 is connected to a second arrangement 409 of switches including a transistor 410 and a transistor 412. The gate of the transistor 410 is connected to ID, and the gate of transistor 412 is connected to $\overline{ID}$. The transistor 410 when turned on connects the output of the decoder 314 to the gate of the transistor 404, and the transistor 412 is connected between the gate of the transistor 404 and a reference voltage.

Based on the alternating connections of ID and $\overline{ID}$ to the gates of the respective transistors 406, 408, 410, and 412, the first arrangement 405 of switches including the transistors 406 and 408 is activated when $\overline{ID}$ is at an active state to connect the decoder output to the gate of the transistor 402. On the other hand, the second arrangement 409 of switches including the transistors 410 and 412 is activated in response to ID being at an active state to connect the decoder output to the gate of the transistor 404.

Each arrangement 405 or 409 of switches when deactivated isolates the decoder output from the respective gate of the transistor 402 or 404.

In the arrangement of FIG. 4, the arrangements 405 and 409 of switches are part of the selector 106 (FIG. 1) or selector 216 (FIG. 2). The decoder 314 is part of the control circuit 212 of FIG. 2.

In general, according to FIG. 4, a circuit for use with a memory element and a nozzle for outputting fluid includes a data line, a fire line, and a selector. The selector includes a first switch arrangement responsive to a first value of the data line to select the memory element, and includes a second switch arrangement responsive to a second value of the data line to select the nozzle. The fire line controls activation of the nozzle in response to the nozzle being selected by the selector, and to communicate data of the memory element in response to the memory element being selected by the selector. The circuit further includes a decoder responsive to an address input to select the memory element or the nozzle.

FIGS. 3 and 4 depict example arrangements where just one decoder is used to address the memory activation element 302 and the memory element 304. In alternative examples, multiple decoders can be used to address the memory activation element 302 and the memory element 304, respectively. An example of such a dual decoder arrangement is shown in FIG. 5.

Figure 5:
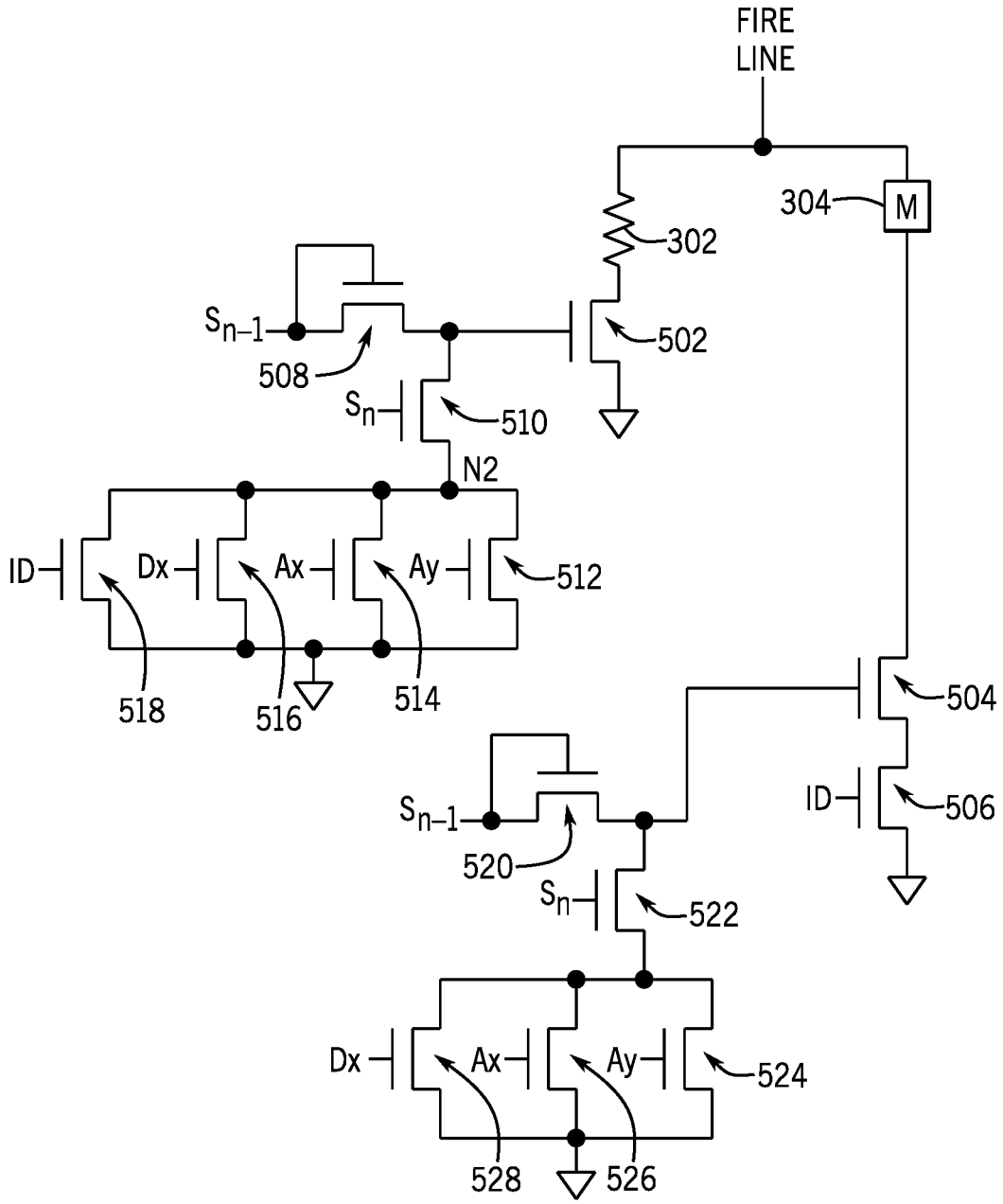

In FIG. 5, the memory activation element 302 and a transistor 502 are connected in series between the fire line and a reference voltage. The memory activation element 304 is connected in series with transistors 504 and 506 between the fire line and a reference voltage.

The gate of the transistor 502 is controlled by a first decoder that includes transistors 508, 510, 512, 514, and 516. $S_n$ represents a select signal, while $S_{n-1}$ represents another select signal. The select signals $S_n$ and $S_{n-1}$ are communicated over a select line(s). The select signal $S_{n-1}$ can be activated earlier in time than the select signal $S_n$.

The transistor 508 is arranged as a diode, and is a pre-charge transistor to pre-charge the gate of the transistor 508 connected to a source of the transistor 508. The select signal $S_{n-1}$ is coupled through the pre-charge transistor 508 to the gate of the transistor 502.

The transistor 510 is connected between the gate of the transistor 502 and a node N2. The transistors 512, 514, and 516 are connected in parallel between the node N2 and a reference voltage. The gate of the transistor 512 is connected to Ay, the gate of the transistor 514 is connected to Ax, and the gate of the transistor 516 is connected to an address data bit Dx. The combination of Ax, Ay, Dx, $S_n$, and $S_{n-1}$ form the address input to the first decoder.

In FIG. 5, another transistor 518 is connected in parallel with the transistors 512, 514, and 516. The gate of the transistor 518 is connected to ID. The transistor 518 is part of the selector (106 or 216), while the first decoder (including the transistors 508, 510, 512, 514, and 516) is part of the control circuit 212.

The gate of the transistor 504 is connected to a second decoder that includes transistors 520, 522, 524, 526, and 528. The transistors 520, 522, 524, 526, and 528 of the second decoder are connected in the same manner as the corresponding transistors 508, 510, 512, 514, and 516 of the first decoder.

As further shown in FIG. 5, the gate of the transistor 506 is connected to ID. The transistor 506 is part of the selector (106 or 216), while the second decoder including the transistors 520, 522, 524, 526, and 528 is part of the control circuit 212.

As shown in FIG. 5, two separate decoders are used to control the respective transistors 502 and 504 that are connected to the nozzle activation element 302 and the memory element 304, respectively.

When ID is at an active state (e.g., high state), the transistor 518 causes the gate of the transistor 502 to remain discharged (i.e., disables the gate of the transistor 502), such that the nozzle activation element 302 is maintained deactivated. On the other hand, when ID is in the active state (e.g., high state), a signal path is established through the transistor 506, such that when the transistor 504 is turned on based on an address input to the second decoder, a data of the memory element 304 can be communicated over the fire line.

On the other hand, when ID is in an inactive state (e.g., low state), the transistor 506 remains off, such that the memory element 304 is deselected. However, when ID is in an inactive state (e.g., low state), the transistor 518 is off, so that the gate of the transistor 502 can be charged to an active state (i.e., the transistor 518 enable the pre-charge of the gate of the transistor 502) to turn on the transistor 502 when the address input to the first decoder causes the first decoder to activate the gate of the transistor 502.

In general, according to FIG. 5, a circuit for use with a memory element and a nozzle for outputting fluid includes a data line, a fire line, and a selector. The selector includes a first switch responsive to a first value of the data line to select the memory element, and includes a second switch responsive to a second value of the data line to select the nozzle. The fire line controls activation of the nozzle in response to the nozzle being selected by the selector, and to communicate data of the memory element in response to the memory element being selected by the selector. The circuit further includes a first decoder responsive to an address input to select the memory element, and includes a second decoder responsive to the address input to select the nozzle.

Figure 5A:
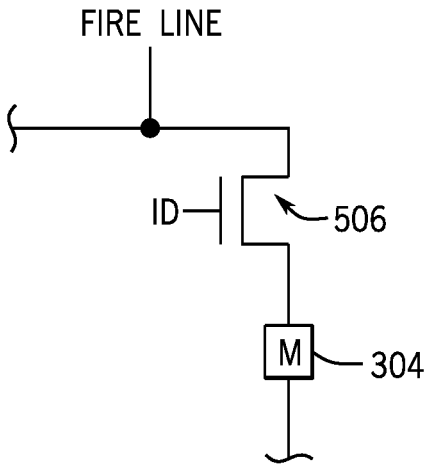
Figure 5B:
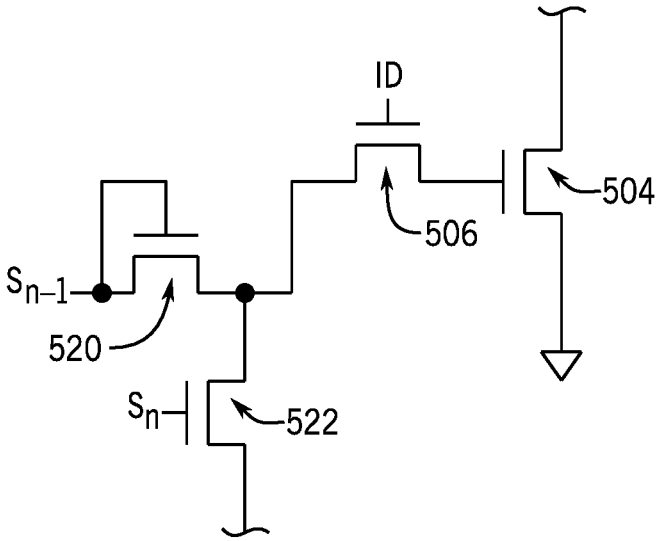

In FIG. 5, the transistor 506 controlled by the ID line is connected between the transistor 504 and a reference voltage. In other variants, the transistor 506 controlled by the ID line can be moved to a different part of the circuit. In one such variant, as shown in FIG. 5A, the transistor 506 is connected between the fire line and the memory element 304. Alternatively, in another variant shown in FIG. 5B, the transistor 506 controlled by the ID line is connected as an enable switch to the gate of the transistor 504—i.e., the drain of the transistor 506 is connected to the common node that connects the source of the transistor 520 and the drain of the transistor 522, and the source of the transistor 506 is connected to the gate of the transistor 504.

Figure 6:
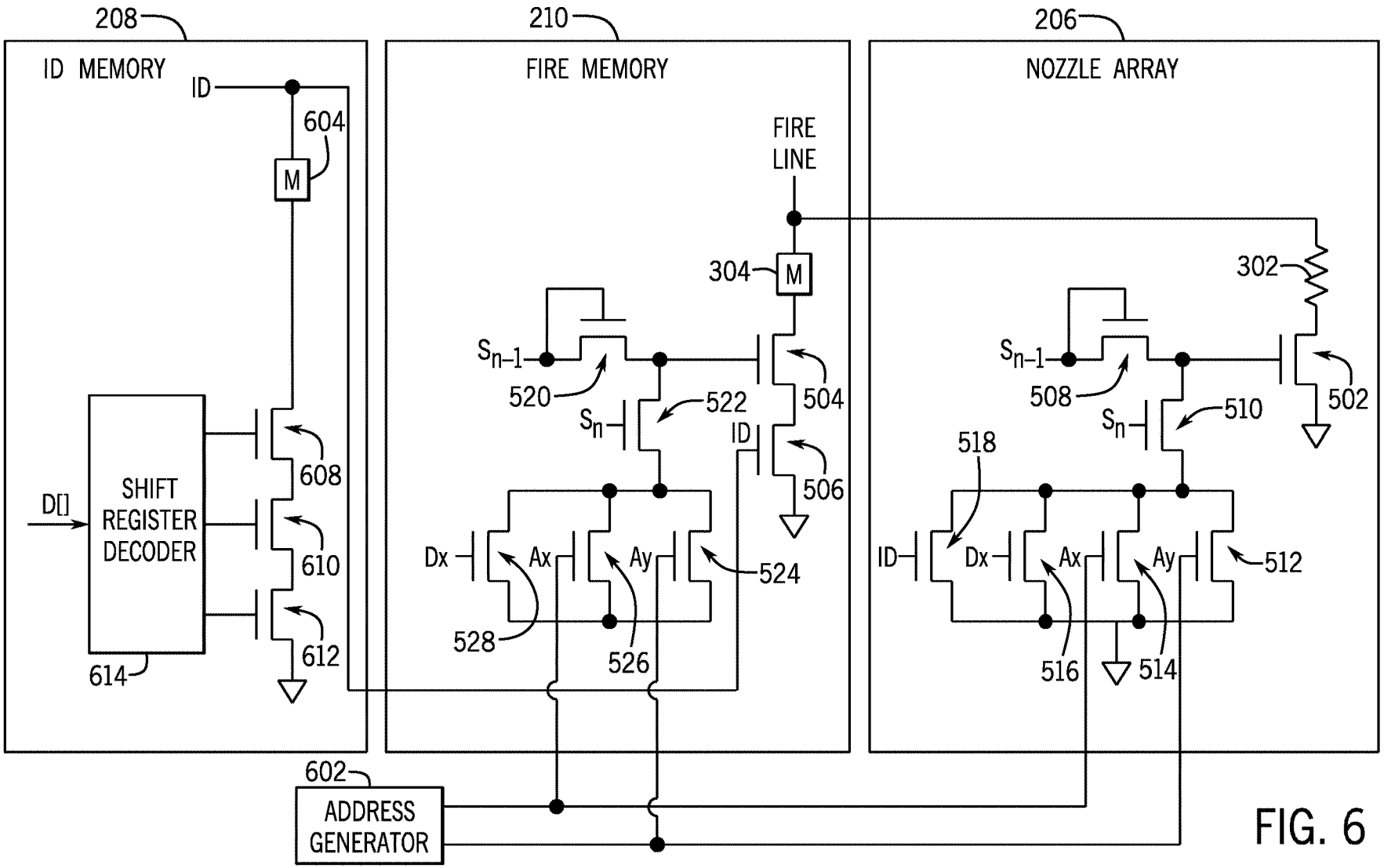

FIG. 6 depicts an example arrangement that uses the circuit of FIG. 5. The arrangement of FIG. 6 includes the ID memory 208, the fire memory 210, and the nozzle array 206. In FIG. 6, the fire memory 210 includes the memory element 304 and the transistors 504, 506, 520, 522, 524, 526, and 528. Note that the arrangement of the circuits in the fire memory 210 shown in FIG. 6 can be repeated for other memory elements of the fire memory 210.

The nozzle array 206 includes the nozzle activation element 302 and transistors 502, 508, 510, 512, 514, 516, and 518. The circuit arrangement shown in FIG. 6 for the nozzle array 206 can be repeated for other nozzle activation elements of the nozzle array 206.

As shown in FIG. 6, Ax and Ay are output by an address generator 602, such as in response to a select signal on the select line and a CSYNC signal on the CSYNC line, for example.

The ID memory 208 includes a memory element 604, 608, 610, and 612 connected in series between the ID line and a reference voltage. When the transistors 608, 610, and 612 are turned on, the memory element 604 is addressed, such that data of the memory element 604 can be communicated over the ID line. The gates of the transistors 608, 610, and 612 are connected to outputs of a shift register decoder 614, which receives address data bits D[ ] (and also select lines).

The shift register decoder 614 includes shift registers connected to each of the D[ ] address data bits that are input to the shift register decoder 614. Each shift register includes a series of shift register cells, which can be implemented as flip-flops, other storage elements, or any sample and hold circuits (such as circuits to pre-charge and evaluate address data bits) that can hold their values until the next selection of the storage elements. The output of one shift register cell in the series can be provided to the input of the next shift register cell to perform data shifting through the shift register. The address data bits provided through each shift register is connected to the gate of a respective one of the transistors 608, 610, and 612. By using shift registers in the shift register decoder 614, a small number of address data bits, D[ ], can be used to select a larger address space. For example, each shift register can include 8 (or any other number of) shift register cells. Assuming that three address data bits are input to the shift register decoder 614 that includes three shift registers, each of length 8, then the address space that can be addressed by the shift register decoder 614 is 512 bits (instead of just 8 bits if the three address bits D[ ] are used without using the shift registers of the shift register decoder 614).

The timings of the various signals shown in FIG. 6 are controlled so that no data corruption occurs during programming of the memory element 604 of the ID memory 208, programming of the memory element 304 of the fire memory 210, and activation of the nozzle activation element 302 of the nozzle array 206. In other words, when the ID memory 208 is being accessed, the fire memory 210 and nozzle array 206 are controlled to be inactive. On the other hand, when the fire memory 210 is being accessed, the ID memory 208 in the nozzle array 206 are controlled to be. When the nozzle array 206 is being activated, the ID memory 208 and fire memory 210 are controlled to be inactive.

In further examples, if multiple fire lines are used, then data can be read from the memory elements of the fire memory 210 in parallel, to increase efficiency in accessing the fire memory 210 over the fire lines.

Figure 7:
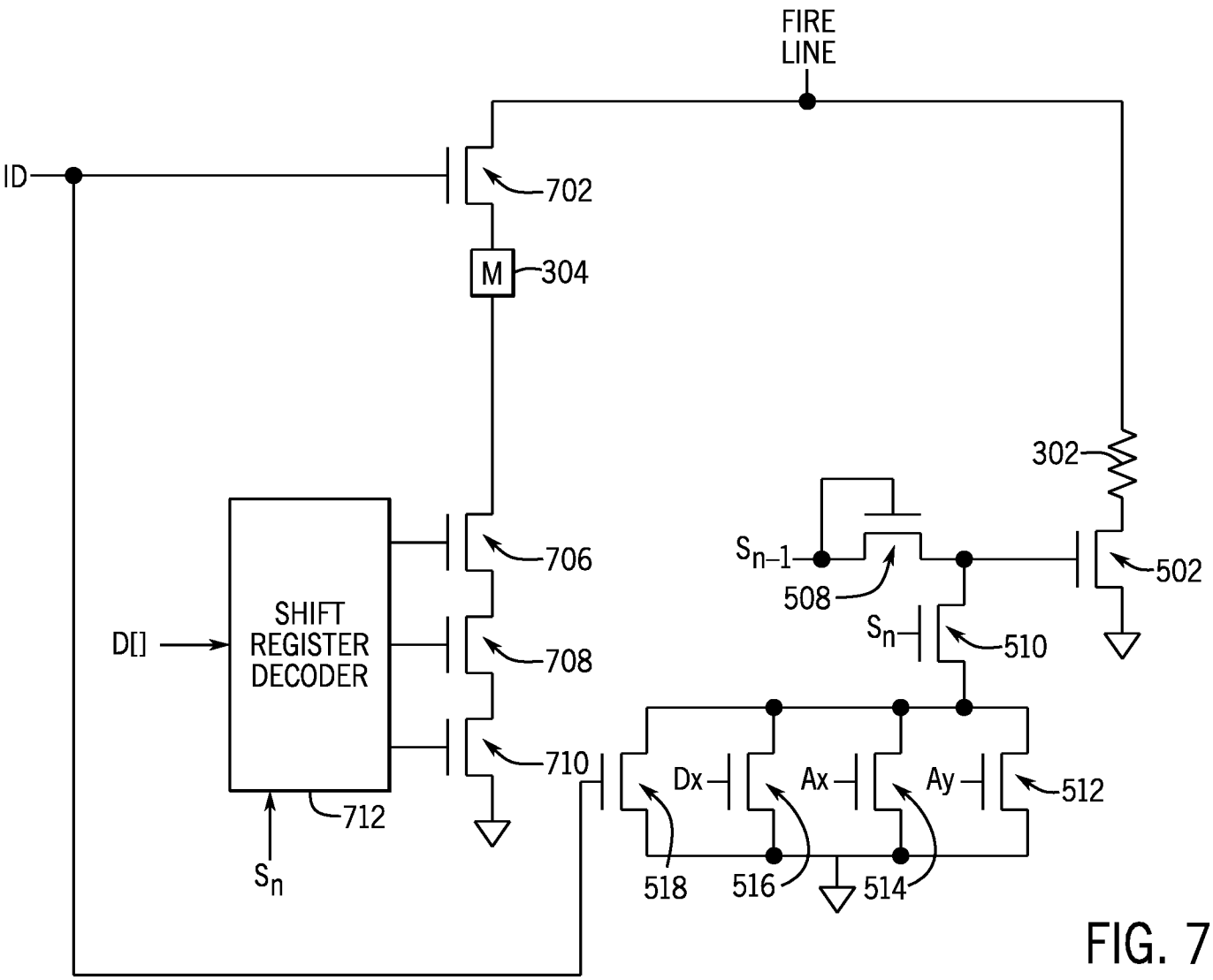

FIG. 7 is a schematic diagram of another example arrangement, which uses a decoder similar to the first decoder of FIG. 5 (including transistors 508, 510, 512, 514, and 516) to control the gate of the transistor 502 that is connected in series with the nozzle activation element 302 and a reference voltage. In addition, the transistor 518 (connected in parallel with the transistors 508, 510, 512, 514, and 516) is controlled by ID.

The memory element 304 is connected in series with transistors 702, 706, 708, and 710. The transistor 702 is controlled by ID, and the gates of the transistors 706, 708, and 710 are connected to outputs of a shift register decoder 712. The shift register decoder 712 is arranged similarly as the shift register decoder 614 of FIG. 6. The shift register decoder 712 includes multiple shift registers to receive corresponding address data bits D[ ]. In addition, the shift register decoder 712 also includes a select input to receive the select signal $S_n$; if $S_n$ is active, then the shift registers of the shift register decoder 712 can receive the respective address data bits D[ ] and shift the address bits along the corresponding shift register cells.

When ID is at an active state (e.g., a high state), the memory element 304 is selected if the address data bits D[ ] and the select signal $S_n$ correspond to the memory element 304. When ID is at an inactive state (e.g., a low state), the memory nozzle activation element 302 is selected if the address data bits D[ ] and the select signal $S_n$ correspond to the nozzle activation element 302.

The transistors 702 and 518 in FIG. 7 are part of the selector 106 or 216, and the decoder (including transistors 508, 510, 512, 514, and 516) and the shift register decoder 712 are part of the control circuit 212 of FIG. 2.

In general, according to FIG. 7, a circuit for use with a memory element and a nozzle for outputting fluid includes a data line, a fire line, and a selector. The selector includes a first switch responsive to a first value of the data line to select the memory element, and includes a second switch responsive to a second value of the data line to select the nozzle. The fire line controls activation of the nozzle in response to the nozzle being selected by the selector, and to communicate data of the memory element in response to the memory element being selected by the selector. The circuit further includes a decoder responsive to an address input to select the nozzle, includes a shift register decoder responsive to the address input to select the memory element.

Figure 8:
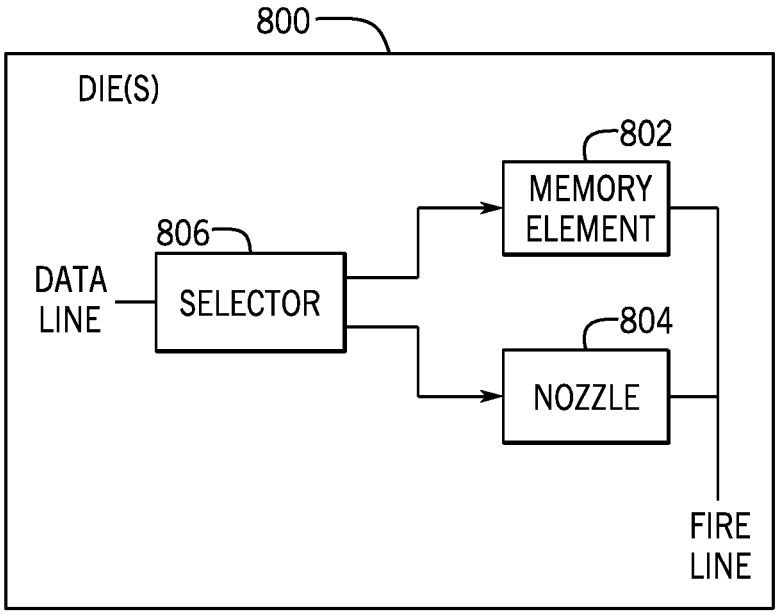
FIG. 8 is a block diagram of one or more dies including a selector, a memory element, and a nozzle, according to further examples.

FIG. 8 depicts a device (e.g., a cartridge or other type of device) that has one or more dies 800 including a memory element 802, a nozzle 804, a fire line coupled to the nozzle 804 and the memory element 802, and a data line. The device further includes a selector 806 responsive to the data line to select the memory element 802 or the nozzle 804, where the selector 806 selects the memory element 802 responsive to the data line having a first value, and selects the nozzle 804 responsive to the data line having a second value different from the first value. The fire line controls activation of the nozzle 804 in response to the nozzle 804 being selected by the selector 806, and communicates data of the memory element 802 in response to the memory element 802 being selected by the selector 806.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A fluid ejection device comprising:

a plurality of memory elements;

a plurality of nozzles for outputting fluid;

a data line;

a fire line; and a selector responsive to the data line to select a memory element or a nozzle, wherein the selector is to select the memory element responsive to the data line having a first value, and to select the nozzle responsive to the data line having a second value different from the first value, wherein the data line is to communicate data of another memory element, the fire line to control activation of the nozzle in response to the nozzle being selected by the selector, and to communicate data of the memory element in response to the memory element being selected by the selector.

2. The fluid ejection device of claim 1, further comprising:

a decoder to receive an address over an address line and to enable the memory element for access in response to the address, wherein the address line is different from the data line.

3. The circuit fluid ejection device of claim 2, wherein the decoder is to enable the nozzle for activation in response to the address.

4. The circuit fluid ejection device of claim 3, wherein the selector comprises:

a first switch to connect to the memory element, the first switch activated when the data line has the first value; and a second switch to connect to a nozzle activation element of the nozzle, the second switch activated when the data line has the second value.

5. The fluid ejection device of claim 4, wherein the first switch comprises a first transistor to connect in series with the memory element, and the second switch comprises a second transistor to connect in series with the nozzle activation element, and wherein a gate of the first transistor is connected to the data line, and a gate of the second transistor is connected to an inverse of the data line.

6. The fluid ejection device of claim 3, wherein the selector comprises:

a first switch to connect an output of the decoder to a first transistor in series with the memory element in response to the data line having the first value; and a second switch to connect the output of the decoder to a second transistor in series with a nozzle activation element of the nozzle in response to the data line having the second value.

7. The fluid ejection device of claim 2, wherein the decoder is a first decoder, and the fluid ejection device further comprises:

a second decoder to receive the address and to enable a nozzle activation element of the nozzle for activation in response to the address.

8. The fluid ejection device of claim 1, wherein the memory element is part of a first memory, and wherein the data line is to communicate data of the another memory element that is part of a second memory responsive to the second memory being enabled for access, wherein the second memory is of a memory type different from the first memory element.

9. The fluid ejection device of claim 1, further comprising:

a decoder to receive an address and to enable a nozzle activation element of the nozzle for activation in response to the address.

10. The fluid ejection device of claim 9, further comprising:

shift registers to receive address inputs and to enable the memory element for access in response to the address inputs.

11. A fluid ejection device comprising:

a plurality of memory elements;

a plurality of nozzles for outputting fluid;

a selector comprising:

a first transistor to select a memory element for access responsive to a data line being set to a first value, wherein the data line is different from an address line to carry an address and the data line is to communicate data of another memory element;

a second transistor to select a nozzle activation element of a nozzle for activation responsive to the data line being set to a second value different from the first value; and a fire line to communicate data of the memory element in response to the first transistor selecting the memory element for access, and to activate the nozzle activation element in response to the second transistor selecting the nozzle activation element of the nozzle for activation.

12. The fluid ejection device of claim 11, wherein the first transistor is to be connected in series with the memory element and a third transistor controlled by a pre-charge transistor that couples a select signal to a gate of the third transistor.

13. The fluid ejection device of claim 11, wherein the second transistor is to:

disable a gate of a third transistor connected in series with the nozzle activation element, in response to the data line being set to the first value, and enable pre-charge of the gate of the third transistor, in response to the data line being set to the second value.

14. A fluid ejection device comprising:

one or more dies that comprise:

a plurality of nozzles to output a printing fluid;

a plurality of memory elements;

a fire line coupled to a nozzle of the plurality of nozzles and a memory element of the plurality of memory elements;

a data line to communicate data of a further memory element, wherein the data line is different from an address line to carry an address; and a selector responsive to the data line to select the memory element or the nozzle, wherein the selector is to select the memory element responsive to the data line having a first value, and to select the nozzle responsive to the data line having a second value different from the first value, the fire line to control activation of the nozzle in response to the nozzle being selected by the selector, and to communicate data of the memory element in response to the memory element being selected by the selector.

15. The fluid ejection device of claim 14, wherein the one or more dies comprise:

a first type of memory comprising the memory element;

a second, different type of memory comprising the further memory element.

16. The fluid ejection device of claim 14, wherein the one or more dies comprise a fluid ejection die that comprises the nozzle.

17. The fluid ejection device of claim 16, wherein the one or more dies comprise another die separate from the fluid ejection die, the another die comprising the memory element.

18. The fluid ejection device of claim 2, wherein the decoder is to receive the address over a plurality of address lines including the address line, and wherein the plurality of address lines are different from the data line.

19. The fluid ejection device of claim 11, wherein the address is carried by a plurality of address lines including the address line, and wherein the plurality of address lines are different from the data line.

20. The fluid ejection device of claim 14, wherein the address is carried by a plurality of address lines including the address line, and wherein the plurality of address lines are different from the data line.

* * * * *